US006267622B1

(12) United States Patent
Nagata

(10) Patent No.: US 6,267,622 B1
(45) Date of Patent: Jul. 31, 2001

(54) CONNECTOR HAVING A MECHANISM FOR PREVENTING INCLINATION OF A CONNECTOR PIN

(75) Inventor: Takayuki Nagata, Higashiosaka (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 09/619,020

(22) Filed: Jul. 19, 2000

(30) Foreign Application Priority Data

Jul. 26, 1999 (JP) ..... 11-210658

(51) Int. Cl.[7] ..... H01R 13/40
(52) U.S. Cl. ..... 439/603
(58) Field of Search ..... 439/733.1, 603, 439/441, 78, 595, 596, 590

(56) References Cited

U.S. PATENT DOCUMENTS 5,370,540 * 12/1994 Kobayashi ..... 439/78

FOREIGN PATENT DOCUMENTS 4-131883 12/1992 (JP) .
2501043 6/1993 (JP) .
11-86992 3/1999 (JP) .

* cited by examiner

*Primary Examiner*—Brian Sircus
*Assistant Examiner*—Phuong K T Dinh
(74) *Attorney, Agent, or Firm*—Townsend and Townsend and Crew LLP

(57) ABSTRACT

A connector for use in e.g. establishing electrical connection between adjacent circuit boards is disclosed. The connector includes a conductive connector pin and an insulator housing. The housing includes a pin retaining hole into which the connector pin is press-fitted. The housing also includes a groove which is open to the face (first face) of the housing for receiving the pin and has a dosed bottom to the other face (second face) opposite from the first face. This groove serves to maintain the pin at its proper posture, while allowing elastic deformation of the housing for prevention of crack in the housing during press-fitting process of the pin.

6 Claims, 5 Drawing Sheets

CONNECTOR HAVING A MECHANISM FOR PREVENTING INCLINATION OF A CONNECTOR PIN

BACKGROUND OF THE INVENTION

1. Field of the Invention

The present invention relates to a connector for use in stacking a plurality of circuit boards. More particularly, the invention relates to a connector typically for use in electric connections between adjacent circuit boards implemented in an electronic device (portable telephone, television set, audio equipment, VTR, OA equipment, etc.). The connector includes a conductive connector pin and an insulator housing, the connector pin being press-fitted within a pin retaining hole formed in the housing.

2. Description of the Related Art

FIG. 8 shows a conventional connector of the above-noted type.

In this connector 100, its housing 101 includes a pin retaining hole 102 formed therethrough for allowing press-fitting of a connector pin 103 within it. The housing includes also, in a side face thereof, a slit 104 which extends from the top to the bottom of the housing 101 in parallel to and communication with the retaining hole 102.

With the above construction, when the connector pin 103 is pressfitted into the pin retaining hole 102, the housing is elastically deformed through the slit 104 for allowing radial enlargement of the retaining hole 102 needed for insertion of the pin. This construction is designed to prevent occurrence of crack in the housing 101, particularly in its thin portions.

According to the above-described conventional connector, however, the side face of the housing 101 is split due to the presence of the slit 104, and the pin retaining hole 102 is open at the portion where the slit is formed. Hence, the connector pin 103 press-fitted into the hole 102 is not retained or restricted at the slit forming portion. That is, the construction cannot provide uniform restricting force over the entire periphery of the shank of the connector pin 103 and there develops flexion of the slit forming portion as indicated by broken lines in FIG. 8. Consequently, the pin 103 tends to slip away toward the slit 104, often leading to inadvertent inclination in the posture of the connector pin 103 retained within the housing 101.

In view of the above, a primary object of the present invention is to provide a connector of the above-noted type which allows the press-fitted connector pin to be reliably and stably maintained at its proper vertical posture, while effectively avoiding occurrence of crack in the housing during the press-fitting process of the connector pin.

SUMMARY OF THE INVENTION

For accomplishing the above object, a connector, according to the present invention, comprises:

a connector pin;

a housing for keeping posture of the connector pin press-fitted within the housing, the housing having a first face for receiving the connector pin and a second face opposite from the first face;

wherein the housing includes a pin retaining hole which is defined through from the first face to the second face and a groove which is open to the first face and has a closed bottom to the second face, the groove allowing elastic deformation of the housing for radial enlargement of the pin retaining hole when the connector pin is press-fitted into the pin retaining hole.

With the above-described construction, the housing includes the groove which is open to the pin receiving face (first face) of the housing and has a dosed bottom to the opposite face (second face) of the housing opposite from its pin-receiving face. Accordingly, when the connector pin is to be press-fitted into the housing, there occurs elastic radial enlargement of the pin retaining hole about the closed bottom of the groove acting as a pivot, thereby to avoid occurrence of crack in the housing Moreover, as this groove has the dosed bottom on the side of the second face of the housing, the integrity of the perimeter (i.e. closed loop) of the pin retaining hole is maintained on the side of the second face of the housing, so as to apply uniform retaining (elastic) force through the entire periphery of the shank of the connector pin press-fitted within the retaining hole. As a result, inadvertent inclining displacement in the posture of the connector pin can be effectively avoided Therefore, the invention has fully achieved its intended object of providing a connector which allows the press-fitted connector pin to be reliably and stably maintained at its proper vertical posture, while effectively avoiding occurrence of crack in the housing during the press-fitting process of the connector pin.

According to one preferred embodiment of the present invention, the housing includes a plurality of said pin retaining holes arranged in a row and a plurality of said grooves, the grooves having one or more intermediate grooves provided in communication with and between at least one adjacent pair of pin retaining holes in the row and an end groove formed from one pin retaining hole disposed at the terminal end of the row through an outer wall of the housing. With this construction, the intermediate groove allows elastic deformation of the housing during insertion of the connector pin into one of the adjacent pin retaining holes and allows also elastic deformation of the housing during insertion of the pin into the other adjacent pin retaining hole. Hence, due to shared use of one groove by two holes adjacent each other, the total number of pin retaining holes to be formed in the housing may be reduced advantageously.

Therefore, disadvantageous reduction in the rigidity of the housing associated with formation of the grooves therein may be minimized for maintaining good pin retaining ability of the housing.

The housing may include a plurality of such rows of pin retaining holes. In this case, it is advantageous to form a single inter-row groove between adjacent rows. With formation of such single inter-row groove, the housing can provide substantially uniform elastic retaining force to the entire peripheries of the shanks of the pins press-fitted within the pin retaining holes of the respective rows.

In the above-described constructions, the end groove and the intermediate groove are formed in communication with the adjacent pin retaining hole(s). While these constructions are advantageous for reduction of the total number grooves to be formed in the housing, it is also possible to form the groove such that it is not communicated with the adjacent pin hole(s) and open to an outer wall of the housing.

According to another preferred embodiment of the invention, the housing includes a pair of said grooves which are arranged in symmetry with each other relative to an axis of the pin retaining hole. This construction is advantageous for being still more effective for applying uniform restricting force to the connector pin to maintain its proper vertical posture, thus restricting inclination of the pin therefrom.

Other features, functions, effects and advantages of the present invention will be appreciated upon reading the following detailed description with reference to the accompanying drawings.

DESCRIPTION OF THE PREFERRED EMBODIMENTS

Preferred embodiments of the invention will now be described in details with reference to the accompanying drawings.

Figure 1:
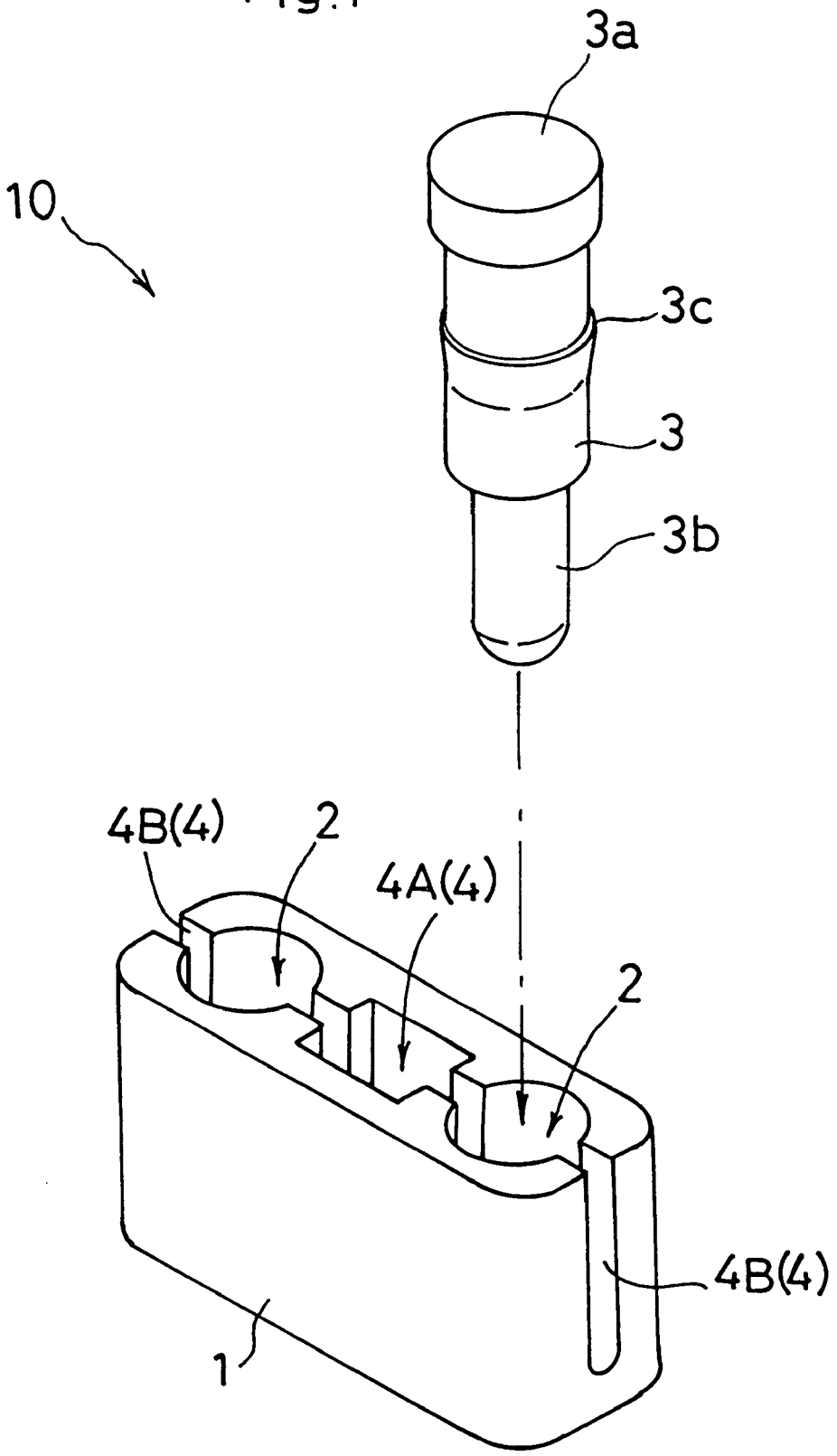
FIG. 1 is a perspective view of a connector relating to a first embodiment of the present invention, showing the connector prior to assembly of a connector pin to a housing.
Figure 2:
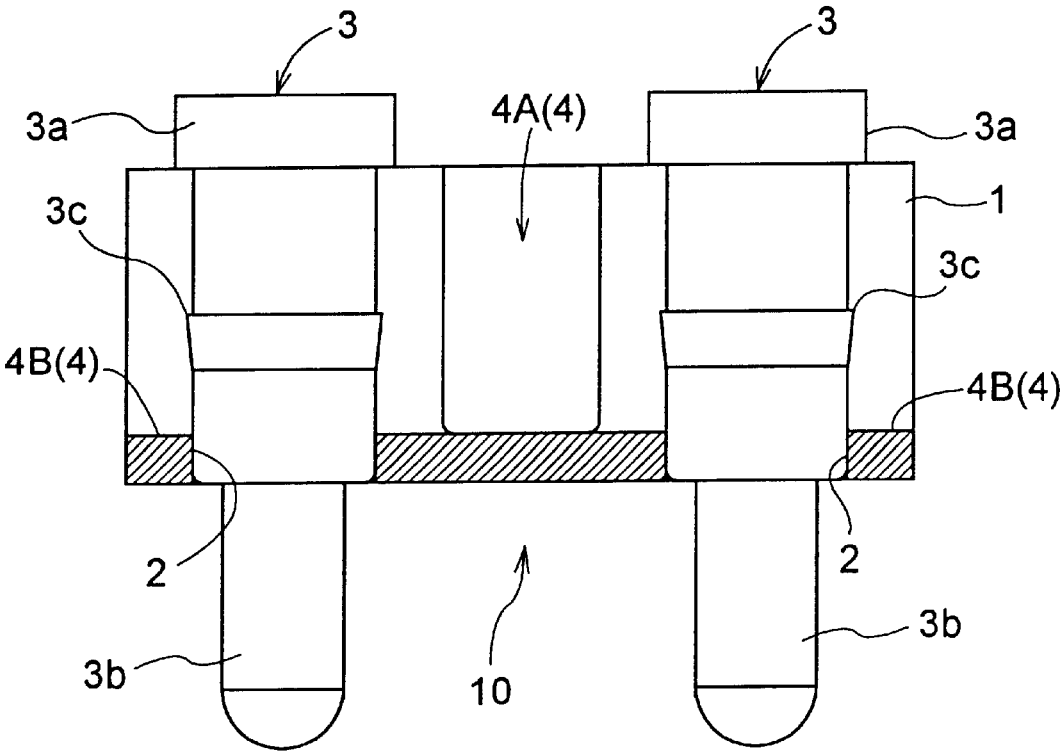
FIG. 2 is a front view in vertical section of the connector of FIG. 1 after the assembly of the connector pin to the housing.
Figure 3:
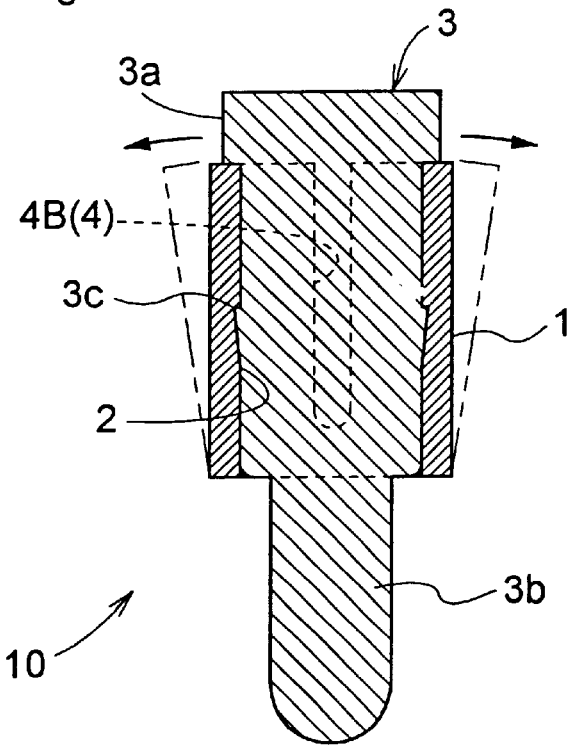
FIG. 3 is a side view in vertical section of the connector of FIG. 1, illustrating elastic deformation of the housing when the connector pin is press-fitted into the housing.

FIGS. 1 through 3 show a connector 10 relating to the first embodiment of the invention. This connector 10 is embodied as a so-called two-pin connector having the basic construction common to the connectors of this type. The connector 10 includes a housing 1 made of insulating material such as synthetic resin, which housing defines two pin retaining holes 3 each allowing press-fitting of a connector pin 3 therein. The connector pin is formed of e.g. bronze alloy with gold plating for obtaining conductivity. The connector pin 3 has a head 3*a* which can be connected, by means of e.g. soldering, to a terminal of a print circuit board (not shown) disposed above and a lower end 8*b* which can be connected, by way of e.g. insertion, to a terminal of another circuit board (not shown) disposed below. The connector pin 3 further includes a stopper 3*c* at an axial intermediate portion thereof for being hooked to the inner peripheral face of the pin retaining hole 2, thus preventing withdrawal of the connecting pin 3 to the inserting side.

In the upper face (first face) of the housing 1 from which the connector pin 3 is received, one end of the pin retaining hole 2 is open and also an end of a groove 4 is open. This groove 4 has a bottom (closed bottom) on the side of the opposite face (second face) of the housing 1 opposite from the first face. That is, the groove 4 is open to the upper face or first face of the housing 1 and is closed on the side of the lower face (second face) of the housing 1. With this, when the connector pin 3 is press-fitted into the pin retaining hole 2, elastic deformation of the housing 1 occurs about the bottom of the groove 4 as the pivot, thus causing elastic radial enlargement of the pin retaining hole 2 (see the broken lines in FIG. 3).

In this embodiment, the housing 1 includes three such grooves consisting of an intermediate groove 4A formed between and in communication with the adjacent pin retaining holes 2, 2 and a pair of opposed end grooves 4B each formed between the adjacent pin retaining hole 2 and an outer side wall portion of the housing 1. These intermediate groove 4A and end grooves 4B are arranged in symmetry with each other in a plan view relative to the axes of the respective pin retaining holes 2.

The longitudinally intermediate portion of the intermediate groove 4A has a greater width than the ends portions of thereof, i.e. the portions communicating with the pin retaining holes 2.

Other Embodiments

The invention is not limited to the above embodiment, but may be modified in many other ways without departing from the scope of the invention defined in the appended claims.

For instance, the housing is not limited to the two-pin type construction described above. Instead, as shown in FIGS. 4–7, the housing ay be embodied to accept more than 3 connector pins. In the drawings relating to the following discussion, the connector pins are not shown for enabling better understanding of modified housings.

Figure 4:
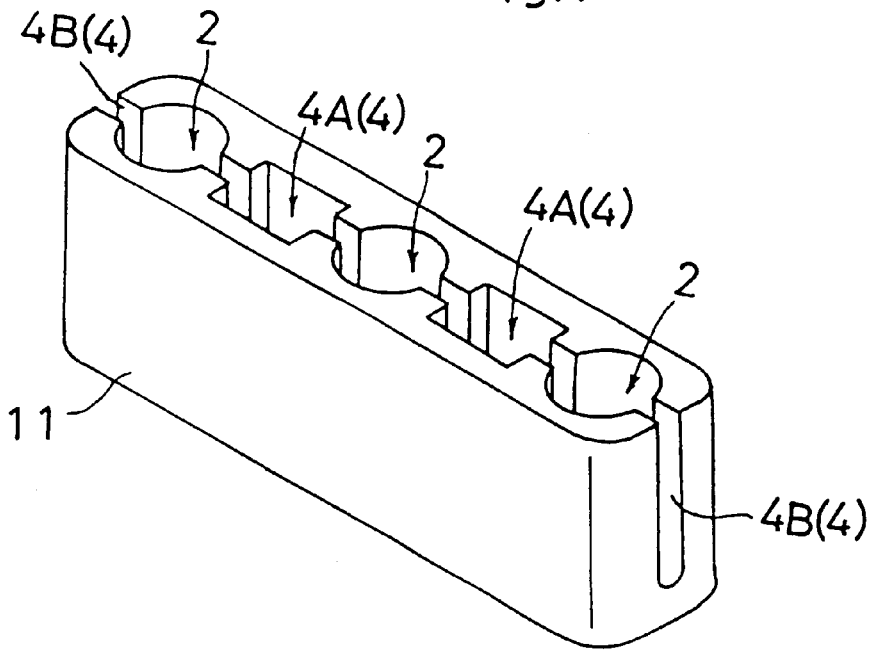
FIG. 4 is a perspective view of a connector relating to a second embodiment of the invention, FIG. 5 a perspective view of a connector relating to a third embodiment of the invention, FIG. 6 a perspective view of a connector relating to a fourth embodiment of the invention, FIG. 7 a perspective view of a connector relating to a fifth embodiment of the invention, and FIG. 8 a perspective view of a conventional connector.
Figure 5:
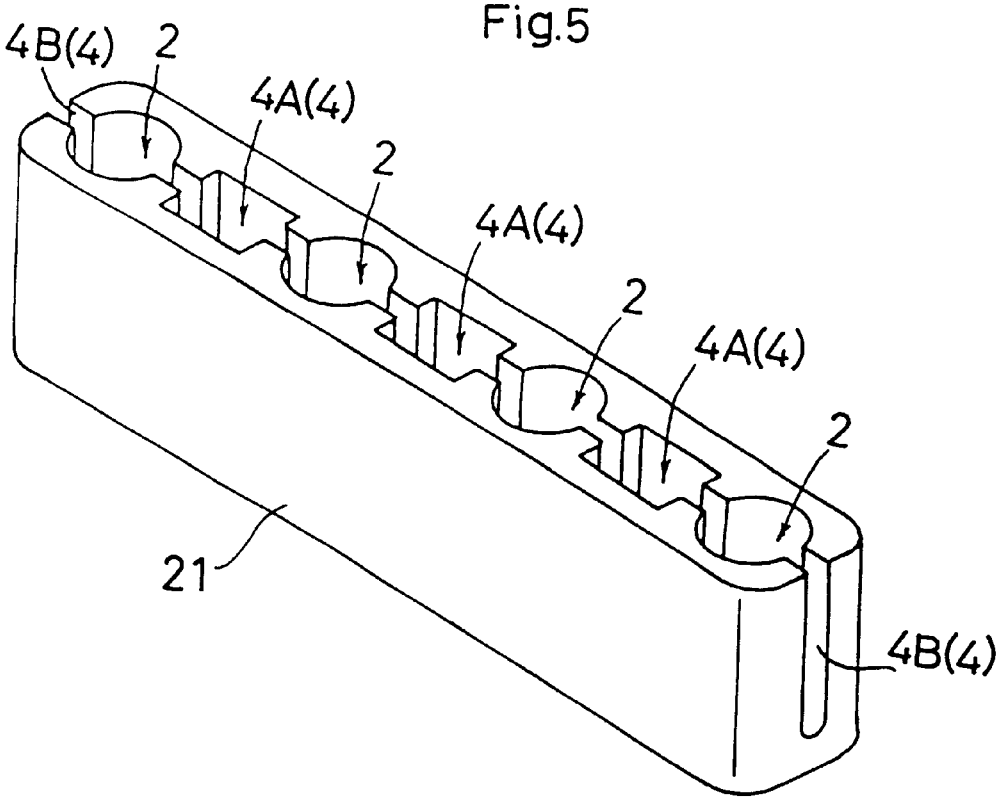
Figure 6:
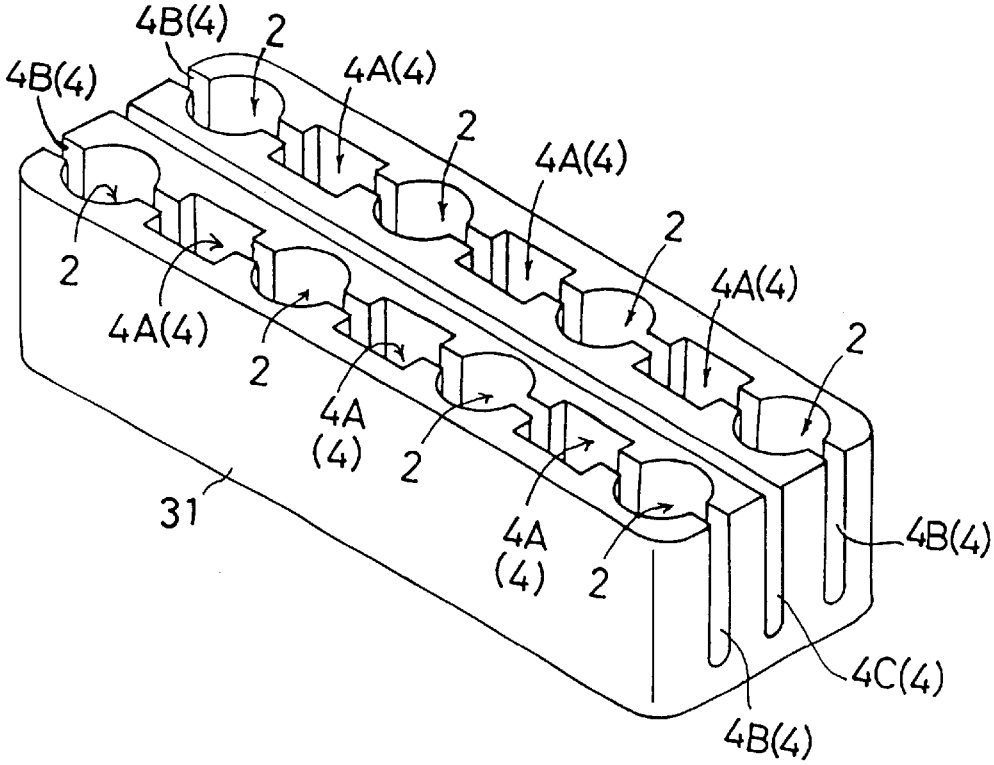

FIG. 4 shows a connector relating to the second embodiment, wherein a housing 11 includes three pin retaining holes 2 arranged in a row. FIG. 5 shows another connector relating to the third embodiment, in which a housing 21 includes four pin retaining holes 2 arranged in a row. In these embodiments, the rest of the constructions are all the same as the first embodiment. Therefore, same reference numerals are given in the figures and the other parts of the constructions will not be described.

Further alternatively, in the connector of the invention, a plurality of rows of pin retaining holes may be provided. For instance, in the fourth embodiment shown in FIG. 6, a housing 31 includes two rows of pin retaining holes 2. In this case, in addition to the intermediate grooves 4A and the end grooves 4B, the housing 31 also includes a single "inter-row" groove 4C formed between the rows of the retaining holes 2. With this, the housing may apply substantially uniform retaining force to the entire periphery of the respective connector pins 3 (their shanks) press-fitted into the corresponding retaining holes 2. The rest of this construction is the same as the foregoing constructions.

In the foregoing embodiments, the intermediate groove 4A and the end groove 4B are formed in communication with each other along a line interconnecting the adjacent pin retaining holes 2, 2. Instead, as in the fifth embodiment shown in FIG. 7, the intermediate groove 14A and the end groove 14B may be formed normal to the interconnecting line, so that the grooves 14A, 14B are not in communication with each other. That is, in this embodiment, the grooves 14 consists of intermediate grooves 14A formed between adjacent pin retaining holes 2, 2 and end grooves 14B formed continuously with the respective pin retaining holes 2. And, each of these intermediate and end grooves 14A, 14B is open individually to the outer wall portion of the housing 41. The rest of the construction of this embodiment is identical to those of the foregoing embodiments.

The present invention has been described by way of some preferred embodiments thereof. However, the present invention is not to be limited to these particular embodiments, but it will be appreciated by one skilled in the art that the invention may be modified in many other manners without departing from the spirit thereof.

For example, in the foregoing embodiments, the intermediate groove is provided between each adjacent pair of pin retaining holes. If the case of a connector having three or more pin retaining holes, the intermediate grooves may not be formed between certain adjacent pairs of pin holes, if appropriate.

Figure 7:
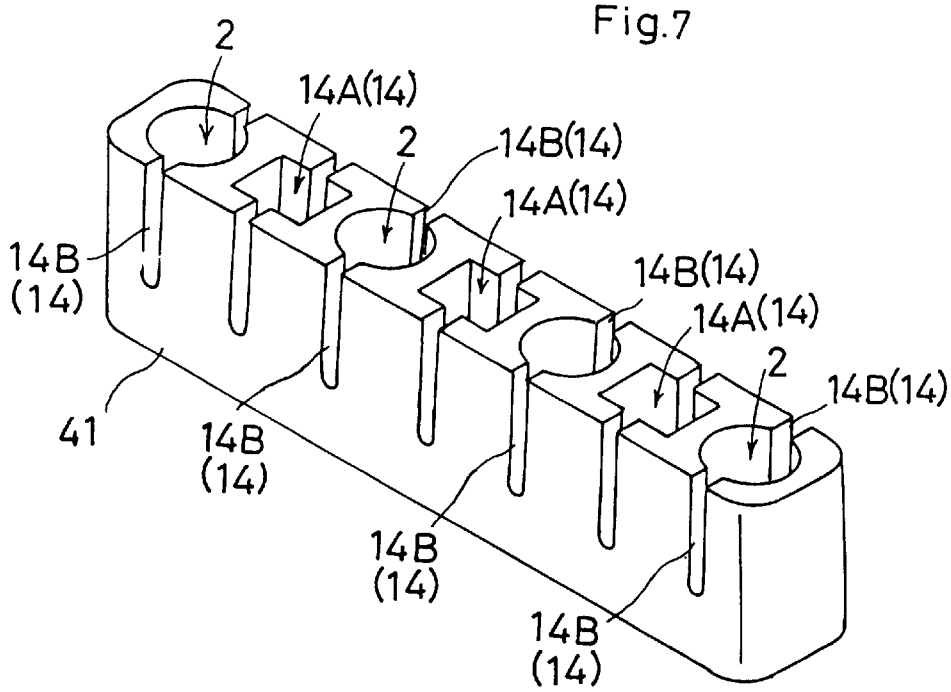
Figure 8:
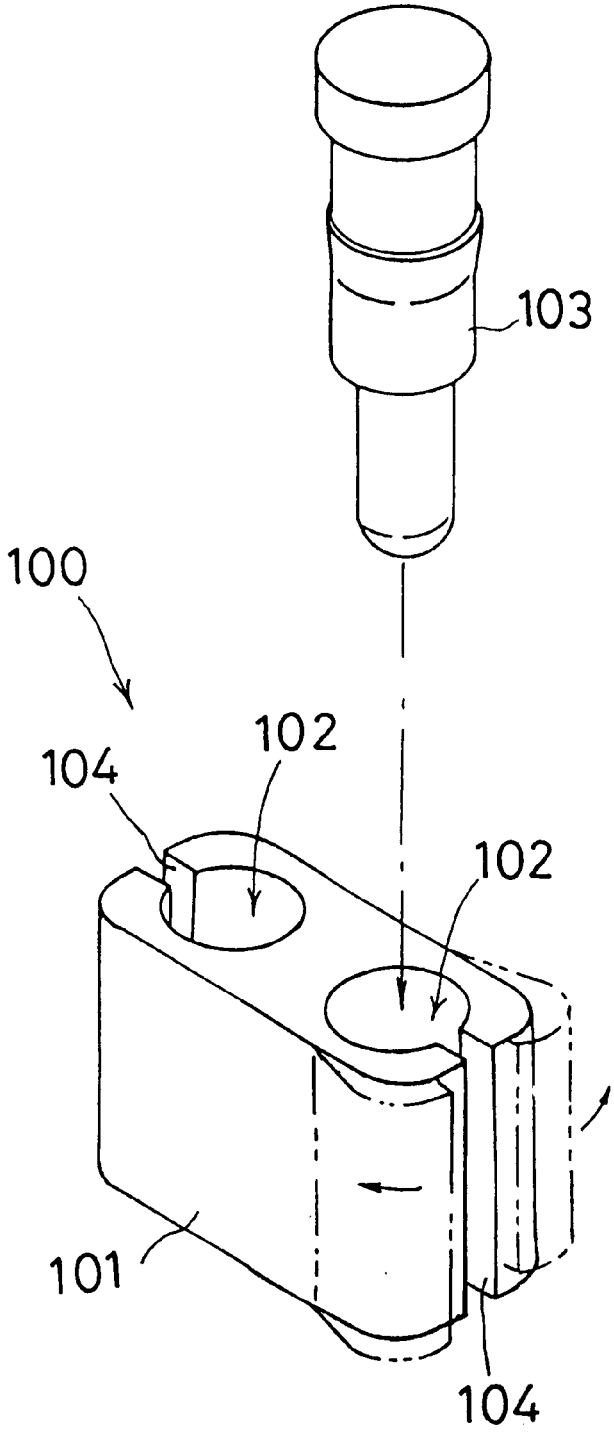
Fig.8 Prior Art

Further, the housing may define a cross-shaped grooves as seen in the plan view thereof. For instance, one same housing may include a groove extending along the interconnecting line of the adjacent pin retaining holes as shown in FIG. 5 and a groove extending normal to the interconnecting line as shown in FIG. 7. That is, if the longitudinal direction of the pin retaining hole is Z direction, the rows of grooves may be formed in both X and Y directions.

Further, the depth of the groove (i.e. the length of the groove from the upper (first) face of the housing toward the lower (second) face of the same) may be determined appropriately, depending on the diameter of the connector pin or the relationship between the pin diameter and the hole diameter of the pin retaining hole. Moreover, the depths of the grooves may be different from each other between the types of the grooves (e.g. between the end terminal groove and the intermediate groove or among the end groove, intermediate groove and the inter-row groove), while each same type of grooves have a common depth. In case the rows of grooves are formed in both X and Y directions as above, the grooves belonging in the X direction row may have a different depth from the grooves belonging in the Y direction row.

What is claimed is:

1. A connector comprising:

a connector pin; and a housing for keeping the connector pin press-fitted within the housing at its proper vertical posture, the housing having a first face for receiving the connector pin and a second face opposite from the first face;

wherein the housing includes:

a plurality of pin retaining holes arranged in a row, each such pin retaining hole being defined through from the first face to the second face;

and a groove which is open to the first face and has a closed bottom to the second face, the groove being provided in communication with and between at least one adjacent pair of said pin retaining holes in the row, the groove allowing elastic deformation of the housing for radial enlargement of the pin retaining hole when the connector pin is press-fitted into the corresponding pin retaining hole.

2. The connector according to claim 1, wherein the housing includes a plurality of said grooves, the grooves having one or more intermediate grooves provided in communication with and between at least one adjacent pair of pin retaining holes in the row and an end groove formed from one pin retaining hole disposed at the terminal end of the row through on outer wall of the housing.

3. The connector according to claim 1, wherein the housing includes a plurality of said rows of pin retaining holes and said groove includes a single interrow groove between adjacent rows.

4. A connector comprising:

a connector pin; and a housing for keeping the connector pin press-fitted within the housing at its proper vertical posture, the housing having a first face for receiving the connector pin and a second face opposite from the first face;

wherein the housing includes:

a plurality of pin retaining holes arranged in a row, each such pin retaining hole being defined through from the first face to the second face; and a groove which is open to the first face and has a closed bottom to the second face, the groove allowing elastic deformation of the housing for radial enlargement of the pin retaining hole when the connector pin is press-fitted into the corresponding pin retaining hole, wherein said groove includes an intermediate groove provided in communication with and between adjacent pin retaining holes in the row and an end groove formed for each of the pin retaining holes, said intermediate groove and said end groove being open to an outer wall of the housing.

5. The connector according to claim 1, wherein the housing includes at least a pair of said grooves which are arranged in symmetry with each other relative to an axis of said pin retaining hole.

6. The connector according to claim 4, wherein the housing includes at least a pair of said grooves which are arranged in symmetry with each other relative to an axis of said pin retaining hole.

* * * * *